US005441106A

United States Patent [19]

Yukitake

[11] Patent Number: 5,441,106

[45] Date of Patent: Aug. 15, 1995

[54] HEAT EXCHANGE TUBES

[75] Inventor: Taizo Yukitake, Llanelli, United Kingdom

[73] Assignee: Llanelli Radiators Limited, Llanelli, United Kingdom

[21] Appl. No.: 313,235

[22] PCT Filed: Jun. 24, 1993

[86] PCT No.: PCT/GB93/01332

§ 371 Date: Sep. 30, 1994

§ 102(e) Date: Sep. 30, 1994

[87] PCT Pub. No.: WO94/00726

PCT Pub. Date: Jan. 6, 1994

[30] Foreign Application Priority Data

Jun. 24, 1992 [GB] United Kingdom ..... 9213358

[51] Int. Cl.[6] ..... F28F 1/40

[52] U.S. Cl. ..... 165/183; 165/177; 29/890.043; 29/890.05

[58] Field of Search ..... 165/177, 179, 183; 29/890.049, 890.05

[56] References Cited

U.S. PATENT DOCUMENTS

| | | | |
|---|---|---|---|
| 1,777,782 | 10/1930 | Bundy | 29/890.049 X |
| 2,151,540 | 3/1939 | Varga | 29/890.049 X |
| 2,757,628 | 8/1956 | Johnston | 29/890.047 |
| 5,185,925 | 2/1993 | Ryan et al. | 29/890.049 |

*Primary Examiner*—Allen J. Flanigan
*Attorney, Agent, or Firm*—McGlynn Bliss

[57] ABSTRACT

A heat exchange tube (1) comprises, in its formed state, an outer wall (4) surrounding a plurality of internal fins (2) which extend along the length of the tube. The fins (2) and outer wall (4) are formed from a unitary portion of sheet material, the fins comprising respective groups of fins extending from a common longitudinal seam line (3) in mutually opposed directions transverse to the longitudinal direction of the tube and seam. The tube (1) is typically formed by means of a roll forming process in which the groups of fins (2) are initially formed in the sheet or strip and portions of the strip subsequently plastically deformed symmetrically about a longitudinal axis of the sheet or strip to provide the outer wall. Typically the tube is formed from sheet or strip aluminum (or an alloy thereof) and the tube subsequently brazed when formed. The heat exchange tube (1) is suitable for use in vehicle radiators, condensers, oil coolers etc.

12 Claims, 4 Drawing Sheets

Figure 6
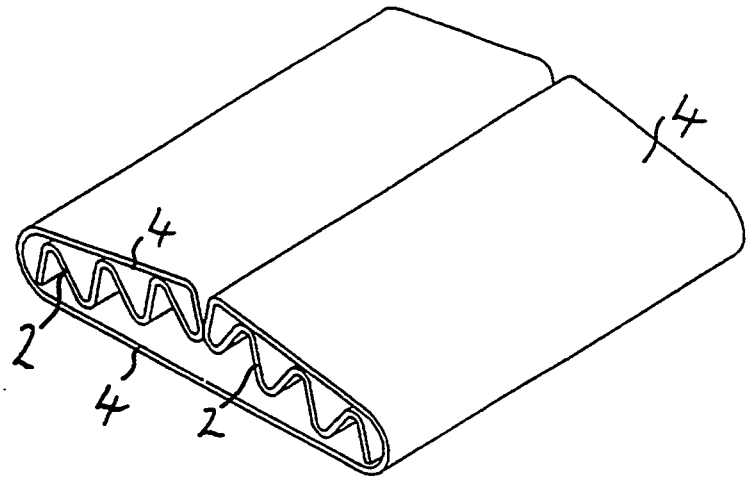
Figure 7
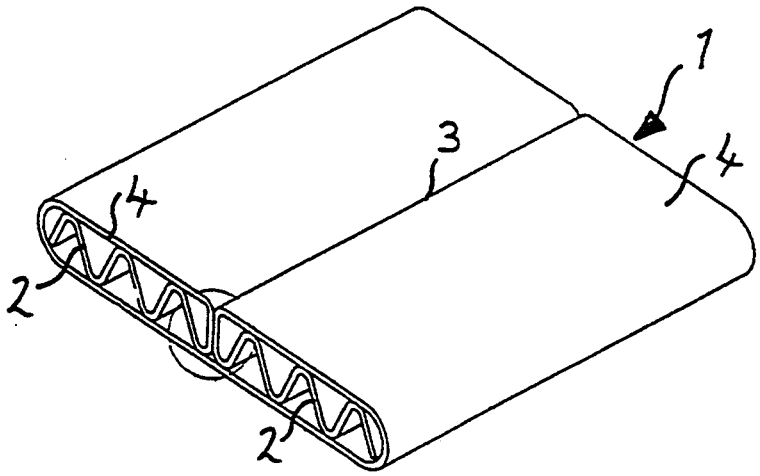
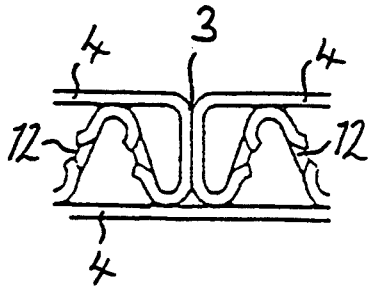
Figure 8

HEAT EXCHANGE TUBES

This invention relates to heat exchanger tubes and in particular to heat exchanger tubes for heat exchangers such as vehicle radiators, condensers, oil coolers, intercoolers and heaters or the like.

Heat exchange tubes are arranged to carry therein a first fluid medium whilst a second fluid medium is in contact with the exterior of the tube. Where a temperature difference exists between the first and second fluid media heat will be transferred between the two via the heat conductive walls of the tube.

It is known to provide corrugated fins or ribs in the interior of heat exchanger tubes to increase the surface area of conductive material available for heat transfer, and/or cause turbulence of the fluid carried in the interior of the tube. In both cases, heat transfer efficiency is increased. In one known construction a roll formed clad aluminium tube is provided with an insert in the form of a sheet of corrugated fins; insertion of the sheet of corrugated fin into the tube is extremely difficult and typically achievable only manually due to required tight dimensional tolerances between the tube and corrugated fin sheet insert. In another known construction, heat exchange tubes are formed by extrusion from aluminium billets. In this construction internal ribs are formed during extrusion, however extruded tubes are formed from aluminium billet and not clad aluminium, which causes problems when attempting to braze the assembled heat exchanger. Furthermore, extruded heat exchange tubes are expensive to produce.

A further heat exchange tube construction is shown in European patent specification 0302232 in which the corrugated insert is formed integrally with the outer wall of the tube by means of deformation of a sheet or strip of metal. The heat exchange tube disclosed in European patent specification 0302232 is however difficult to produce in practice particularly where automated production is required.

An improved heat exchange tube has now been devised which alleviates some of the above-mentioned difficulties.

According to a first aspect of the invention, there is provided a heat exchange tube comprising an outer wall surrounding a plurality of internal fins extending longitudinally of the tube, the fins and outer wall being formed from a unitary portion of sheet or strip material, the fins comprising respective groups of fins each group comprising a respective shaped portion of the sheet or strip material, the groups of fins extending from a common longitudinal seam line in mutually opposed directions which opposed directions are transverse to the longitudinal direction of the tube.

The common longitudinal seam line comprises a line of abutment of respective portions of the wall of the tube which are inverted during forming to position the groups of fins internally of the tube.

Typically the common longitudinal seam line comprises a bonded join, typically a brazed join.

It is preferred that a pair of groups of fins are provided, advantageously extending transversely from the seam line to substantially the same extent such that in transverse cross-section the tube is preferably substantially symmetrical about the seam line.

Desirably, the shaped portions of the strip or sheet material defining each group of fins are preferably separated from one another by interconnecting portions, which interconnecting portions are not provided with fins.

Advantageously, the groups of fins are provided each adjacent a respective longitudinally running peripheral edge of the sheet or strip material.

The tube is required to be heat conductive, and therefore the strip or sheet material from which the tube is formed is typically of metal or alloy. It is preferred that the strip or sheet material comprises clad aluminium to aid in the brazing of the tube and also the brazing of the final heat exchanger assembly. Portions of the fins are typically brazed to respective portions of the outer wall to improve the thermal conductive connection therebetween.

According to a second aspect, the invention therefore comprises a heat exchanger having one or more heat exchange tubes as defined herein.

In use, the heat exchange tubes are arranged for flow of heat transfer fluid therethrough from an inlet to an outlet spaced therefrom along a fluid flow path between the inlet and outlet defined by the tube.

Advantageously, the outer surface profile of the tube is arranged such that effectively two substantially parallel external heat exchange surfaces are provided. It is preferred that the width of the heat exchanger tube is substantially greater than its thickness.

Typically, each group of fins in the interior of the tube are corrugated, comprising alternating troughs and crests in thermally conductive contact with respective opposed portions of the outer wall. In a similar manner, the corrugated fins may comprise castellations or any other suitable configuration having fin surfaces extending between opposed portions of the outer wall of the tube. In a preferred embodiment the corrugated fins are provided with louvres or slits such that fluid may pass through the surfaces of the corrugated fins. Typically, the corrugated fins define a plurality of longitudinally extending fluid flow pathways along the interior of the tube.

Typically, the heat exchange tube is formed by a roll forming process, and therefore, according to a third aspect, the invention comprises a method of forming a heat exchange tube comprising forming respective groups of fins in respective deformable portions of strip or sheet material, and subsequently deforming further portions of the strip or sheet material to provide an outer wall surrounding the groups of fins, whereby the groups of fins extend from a common longitudinal seam line in mutually opposed directions which directions are transverse to the longitudinal direction of the seam line.

Desirably, two respective groups of fins are provided, each in the region of a respective longitudinally running edge of the strip or sheet material.

Advantageously, subsequently to formation of the groups of fins, the sheet material is deformed symmetrically about a longitudinal axis to form the heat exchange tube.

It is preferred that the portions of the sheet material provided with respective groups of fins are folded (typically by roll forming) toward one another causing intermediate portions of the sheet or strip material to wrap around the groups of fins thereby providing the outer wall.

Typically, the tube is then brazed along the seam line to form a joining interface between the respective groups of fins.

The invention will now be further described in a specific embodiment by way of example only and with reference to the accompanying drawings, in which:

FIGS. 5 and 6 show successive intermediate stages in the formation of a heat exchanger tube according to the invention;

FIG. 7 shows a section of finished heat exchanger tube according to the invention;

FIG. 8 shows a preferred embodiment of a part of the heat exchanger tube shown in FIG. 7.

Figure 1:
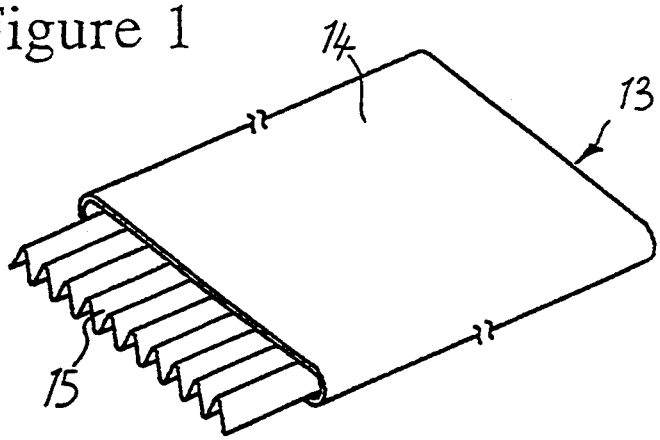
FIGS. 1 to 3 show known heat exchange tubes of various constructions.
Figure 2:
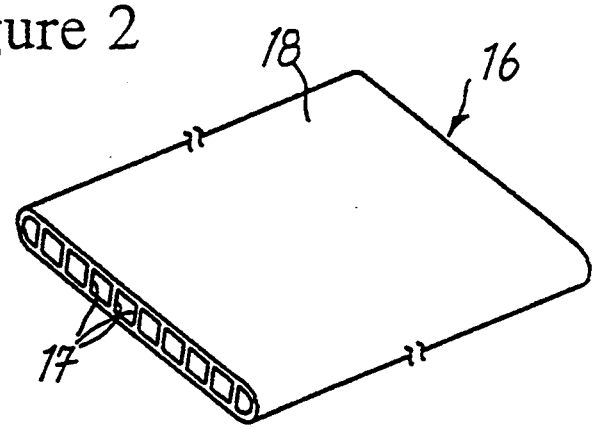
Figure 3:
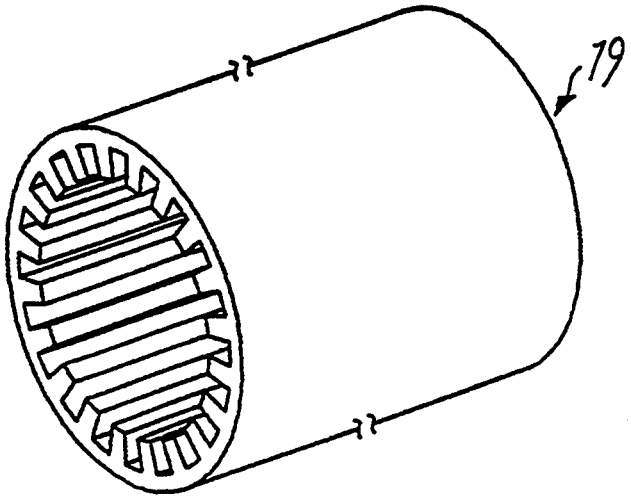

Referring initially to FIGS. 1 to 3, various types of known (prior art) heat exchanger tubes are shown. FIG. 1 shows a tube 13 which comprises an outer wall 14 roll formed from clad aluminium strip which is then brazed along a longitudinal edge. A fin corrugated insert 15 is subsequently inserted into line tube and brazed to give a good thermal connection to the outer wall 14.

Referring to FIG. 2, there is shown an extruded heat exchange tube 16 which is extruded integrally from aluminium billet stock. Fins 17 are formed integrally with the outer wall 18 during extrusion. Referring to FIG. 3, there is shown a typical oil cooler heat exchange tube 19 extruded from billet stock.

Referring now to FIGS. 4 to 9 which relate to the present invention, there is shown a section of elongate heat exchanger tube generally designated 1. The tube shown is suitable for use in heat exchangers such as vehicle radiators, condensers, oil coolers, intercoolers, heaters etc. where heat is to be transferred between a first fluid medium carried in the interior of tube 1 (usually at a relatively high temperature for radiators and oil coolers) and a second fluid medium which passes over the exterior surfaces of the tube (usually at a relatively lower temperature for radiators and oil coolers).

The tube 1 is formed integrally from a single initially flat strip of clad aluminium by a roll forming process (described below) such that integral corrugated fins 2 are formed in the interior of the tube 1. The tube is then brazed (typically in unison with the remainder of the assembled heat exchanger) using a known brazing process to give a single longitudinal brazed tube join along longitudinal seam 3 and give good brazed thermally conductive connection between the crests and troughs of the corrugated fins 2 and the interior of the outer surrounding tube wall 4.

Figure 4:
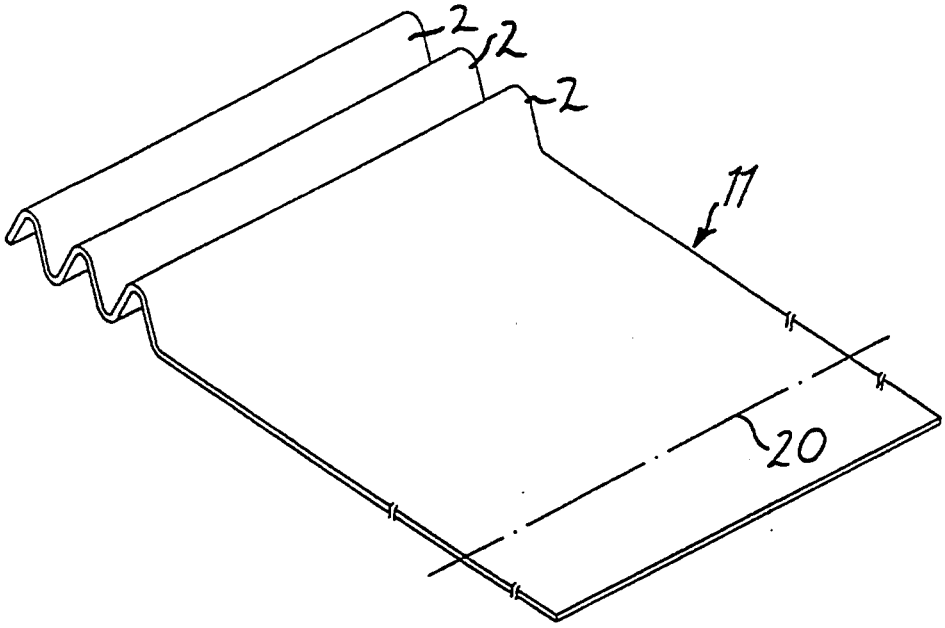
FIG. 4 shows an initial stage in the formation of a heat exchanger tube according to the invention.
Figure 5:
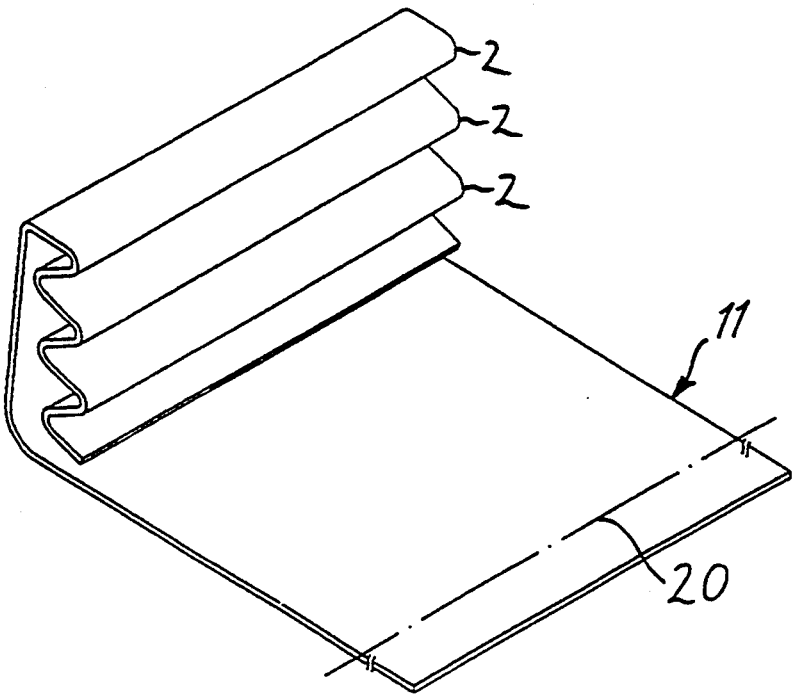
Figure 9:
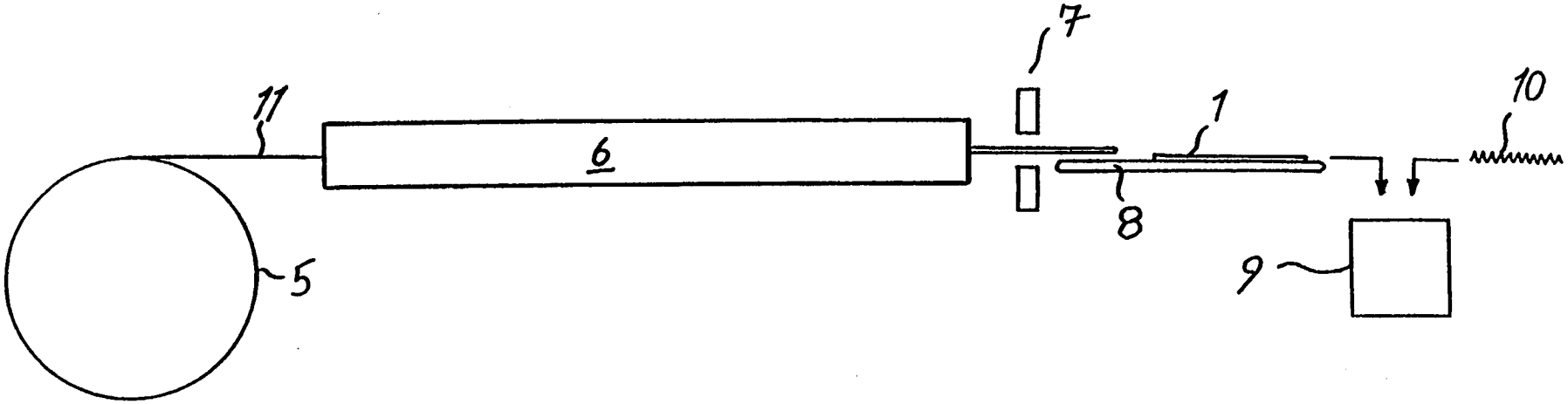
FIG. 9 is a schematic representation of apparatus arranged to form the finished heat exchanger tube shown in FIG. 7.

Referring to FIG. 9, a continuous clad aluminium strip 11 is fed from a reel 5 into the first station of multi-station roll forming apparatus 6. Typically, the roll forming apparatus 6 has between 10 and 40 stations, each station typically comprising pairs of rolls arranged to symmetrically plastically deform respective portions of the aluminium strip to a predetermined pattern or configuration. For example, an initial series of roll stations will be arrange to successively deform the longitudinal peripheral portions of the strip to provide respective series of corrugated fins 2 shown in FIG. 4 (only one peripheral portion is shown in FIGS. 4 and 5). Intermediate stations in the roll forming apparatus 6 successively deform the strip to the configurations shown in FIGS. 5 and 6 until, on leaving the roll forming apparatus 6, the configuration of the strip has been deformed to that shown in FIG. 7 which is the finished configuration of the tube. Because the aluminium strip is arranged to be deformed to the required configuration symmetrically about its longitudinal axis 20, the manufacturing process using the series of "in-line" roll forming stations 6 is particularly convenient. It is therefore possible to conveniently form an efffectively continuous heat exchange tube from unitary sheet with integrally formed internal fins. Because the tube 1 is symmetrical about the brazed seam 3, the integrity and rigidity of the tube is also maximised.

On leaving the roll forming apparatus 6 the continuous tube is cut to the required length at a cutting station 7 before being carried on conveyor 8 to a heat exchanger jig 9 in which the cut to length tubes 1 are placed alternately with layers of concertinad fins 10 (which define the seconet fluid flow matrix) before the assembled heat exchanger is brazed in a single brazing operation.

Referring to FIG. 8, certain stations in the roll forming apparatus may be provided with perforating means arranged to produce perforated louvres or slits 12 in the corrugated fins 2. The louvres 12 increase the turbulence of the fluid medium carried in the tube 1, and hence increases the heat transfer efficiency between the two fluid media.

I claim:

1. In a longitudinally extending heat exchange tube comprising an outer wall having an inner face and an outer face, and a plurality of internal fins extending longitudinally of the tube, the fins and outer wall being formed from a unitary portion of sheet or strip material, each of the fins comprising a respective corrugated portion of the sheet or strip material, the improvement comprising that said fins comprise a first series of fins and a second series of fins, each of said first and second series comprising a plurality of said fins successively spaced in mutually opposed directions, from a common longitudinal seam line which opposed directions are transverse to the longitudinal direction of said tube, each of said fins being in the interior of said tube with alternating troughs and crests in thermally conductive contact with respective opposed portions of said inner face.

2. A heat exchange tube according to claim 1, wherein the common longitudinal seam line comprises a bonded join.

3. A heat exchange tube according to claim 1, wherein in transverse cross-section the tube is substantially symmetrical about the seam line.

4. A heat exchange tube according to claim 1, wherein the shaped portions of the sheet or strip material defining each series of fins are separated from one another by interconnecting portions, which interconnecting portions are not provided with fins.

5. A heat exchange tube according to claim 1, wherein the series of fins are formed each adjacent a respective longitudinally running peripheral edge of the sheet or strip material.

6. A heat exchange tube according to claim 1, wherein the fins have louvres or slits such that fluid may pass through the surfaces of the fins.

7. A heat exchange tube according to claim 1, wherein the sheet or strip material comprises clad aluminum or clad aluminum alloy.

8. A method of forming a heat exchange tube comprising forming respective series of fins in respective deformable portions of strip or sheet material, and subsequently deforming further portions of the strip or sheet material to provide an outer wall surrounding the series of fins, whereby the series of fins extend from a common longitudinal seam line in mutually opposed directions which directions are transverse to the longitudinal direction of the seam line.

9. A method according to claim 8, wherein the strip or sheet material is deformed symmetrically about its longitudinal axis to form the heat exchange tube.

10. A method according to claim 8, wherein two respective series of fins are formed, each in the region of a respective longitudinally running peripheral edge of the strip or sheet material.

11. A method according to claim 8, wherein the deformable portions of the strip or sheet material are provided with respective series of fins are folded toward one another causing intermediate portions of the strip or sheet material to wrap around the series of fins thereby providing the outer wall.

12. A method according to claim 8, wherein the tube is brazed along the seam line to form a joining interface between the respective series of fins.

* * * * *

UNITED STATES PATENT AND TRADEMARK OFFICE

CERTIFICATE OF CORRECTION

PATENT NO. : 5,441,106

DATED : August 15, 1995

INVENTOR(S) : Taizo Yukitake

It is certified that error appears in the above-indentified patent and that said Letters Patent is hereby corrected as shown below:

Title page Line 8, after Attorney, Agent, or Firm "McGlynn Bliss" should be --Bliss McGlynn, P.C.--.

Column 3, Line 23, "line" should be --the--.

Column 4, Line 17, "seconet" should be --second--.

Signed and Sealed this

Seventh Day of November, 1995

*Attest:*

*Attesting Officer*

BRUCE LEHMAN

*Commissioner of Patents and Trademarks*